US007997575B2

(12) United States Patent
Dobrindt et al.

(10) Patent No.: US 7,997,575 B2
(45) **Date of Patent: *Aug. 16, 2011**

(54) DEVICE FOR DEPOSITING SHEETS IN A STACK

(75) Inventors: Dirk Dobrindt, Klausdorf/Schwentine (DE); Rolf Dieter Gritzuhn, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/618,995

(22) Filed: Nov. 16, 2009

(65) Prior Publication Data

US 2010/0059931 A1 Mar. 11, 2010

Related U.S. Application Data

(63) Continuation of application No. 10/590,280, filed as application No. PCT/EP2005/001835 on Feb. 22, 2005, now Pat. No. 7,658,377.

(30) Foreign Application Priority Data

Feb. 23, 2004 (DE) ..... 10 2004 008 776

(51) Int. Cl.
*B65H 29/20* (2006.01)

(52) U.S. Cl. ..... 271/187; 271/315

(58) Field of Classification Search ..... 271/187, 271/178, 315, 224; 414/793.9, 794; 198/404
See application file for complete search history.

(56) References Cited

U.S. PATENT DOCUMENTS

| | | | | |
|---|---|---|---|---|
| 3,046,009 | A * | 7/1962 | Hartel | 271/176 |
| 4,228,997 | A * | 10/1980 | Schoonmaker et al. | 271/315 |
| 4,431,177 | A * | 2/1984 | Beery et al. | 271/186 |
| 5,058,880 | A * | 10/1991 | McGraw et al. | 271/315 |
| 5,114,135 | A * | 5/1992 | Evangelista et al. | 271/187 |

(Continued)

FOREIGN PATENT DOCUMENTS

EP 0 867 394 A 10/2002

(Continued)

OTHER PUBLICATIONS

*Dictionary of Pure and Applied Physics*, vol. I: German-English, Complied by Dr. Louis DeVries and W. E. Clason, pp. 47 and 287, Elsevier Publishing Company, 1963.

*Primary Examiner* — Jeremy Severson
(74) *Attorney, Agent, or Firm* — Donna P. Suchy; Christopher J. White

(57) ABSTRACT

The present invention relates to a device for depositing sheets for a printing machine, said device comprising at least one rotating drivable sheet transport element, which is designed to receive or grasp a leading edge of a sheet and deposit said sheet on a stack after said sheet has traveled a path of rotation, and comprising at least one drag element for pulling a sheet that has been deposited on the stack toward a mechanical stop. With the present invention, the drag element is coupled with the rotation of the sheet transport element and is arranged in such a manner that said drag element can assume an inoperative position within the region covered by the rotating sheet transport element, and that said drag element, in order to perform its dragging function, can be moved at least partially out of the region covered by the rotating sheet transport element.

10 Claims, 4 Drawing Sheets

U.S. PATENT DOCUMENTS

| | | | | |
|---|---|---|---|---|
| 5,194,558 | A | 3/1993 | Carlston et al. | |
| 5,803,705 | A * | 9/1998 | Keyes | 414/793.9 |
| 5,899,448 | A * | 5/1999 | Hosking | 271/3.08 |
| 6,109,605 | A * | 8/2000 | Hirota et al. | 271/186 |
| 6,199,860 | B1 * | 3/2001 | d'Agrella et al. | 271/315 |
| 6,341,779 | B1 * | 1/2002 | Merritt | 273/292 |
| 6,612,563 | B1 * | 9/2003 | Noll, Jr. | 271/69 |
| 6,619,653 | B2 * | 9/2003 | Dobrindt | 271/83 |
| 7,222,850 | B2 * | 5/2007 | Dobrindt | 271/315 |
| 7,635,130 | B2 * | 12/2009 | Dobrindt | 271/315 |
| 7,658,377 | B2 * | 2/2010 | Dobrindt et al. | 271/187 |
| 7,731,185 | B2 * | 6/2010 | Dobrindt | 271/187 |
| 2007/0210508 | A1 | 9/2007 | Dobrindt | |

FOREIGN PATENT DOCUMENTS

| | | |
|---|---|---|
| FR | 2 760 733 | 3/1997 |

* cited by examiner

DEVICE FOR DEPOSITING SHEETS IN A STACK

CROSS REFERENCE TO RELATED APPLICATIONS

This application is a continuation of prior U.S. patent application Ser. No. 10/590,280 filed Apr. 30, 2007 now U.S. Pat. No. 7,658,377 which was the national stage of International Application No. PCT/EP2005/001835 filed Feb. 22, 2005 which claims the benefit of DE 102004008776.8 filed Feb. 23, 2004 each of which is incorporated herein by reference in its entirety.

FIELD OF THE INVENTION

The present invention relates to a device for depositing sheets for a printing machine, preferably an electrophotographically operating printing machine, said device comprising at least one rotating drivable sheet transport element, which is designed to receive or grasp a leading edge of a sheet and deposit said sheet on a stack after said sheet has traveled a path of rotation, and comprising at least one drag element for pulling a sheet that has been deposited on the stack toward a mechanical stop.

BACKGROUND OF THE INVENTION

If such a device places a sheet on a stack against a mechanical stop, this sheet is released when deposited and, in this very moment, may bounce off said stop as a result of the impelling force applied to said sheet due to the rotation of the sheet transport element. This way of depositing a sheet, however, does not result in a neatly aligned stack. Therefore, the known device is operated such that, after the sheet has been deposited on the stack, said sheet is again pulled back against the stop by a drag element and, in so doing, is oriented and, in particular, aligned. This is particularly important if toner was applied to the sheet dining the printing process because, as a result of the application of toner to the sheet, said sheet may exhibit a varying overall thickness or a varying total material thickness, which, for example, causes the sheet to be systematically deposited on the stack in a wedge-shaped or curved manner, thus resulting in a corresponding leaning or buckling of the entire stack.

However, because the sheets are placed on a stack in potentially varying ways, the ultimate total height of the stack can be predicted only with difficulty, thus making the adjustment of the upper side to the correct level relative to the depositing device difficult; this, for example, could be accomplished by a stack depositing means which is lowered as the stack grows. Therefore, it must be taken into account that the drag element must overcome a greater height difference than expected, in which case a greater height difference also aids a sheet in bouncing off the stop. For example, a height difference of approximately only 2 to 3 mm could be desirable and, still, a height difference of, for example, approximately 15 mm or more could occur, in which case this height difference could additionally vary along a stop bar or a stack edge due to the wedging or buckling mentioned above.

Therefore, the object to be achieved by the present invention is to improve a device of the above-mentioned type in that at least one drag element is actuated at the right time at the right location.

SUMMARY OF THE INVENTION

In accordance with the present invention, this object is achieved in that the drag element is coupled with the rotation of the sheet transport element and is arranged in such a manner that said drag element can assume an inoperative position within the region covered by the rotating sheet transport element, and that said drag element, in order to perform its dragging function, can be moved at least partially out of the region covered by the rotating sheet transport element.

BRIEF DESCRIPTION OF THE DRAWINGS

One embodiment, which discloses additional inventive features, which, however, does not restrict the scope of this invention, is shown by the drawings. They show.

DETAILED DESCRIPTION OF THE INVENTION

Figure 1:
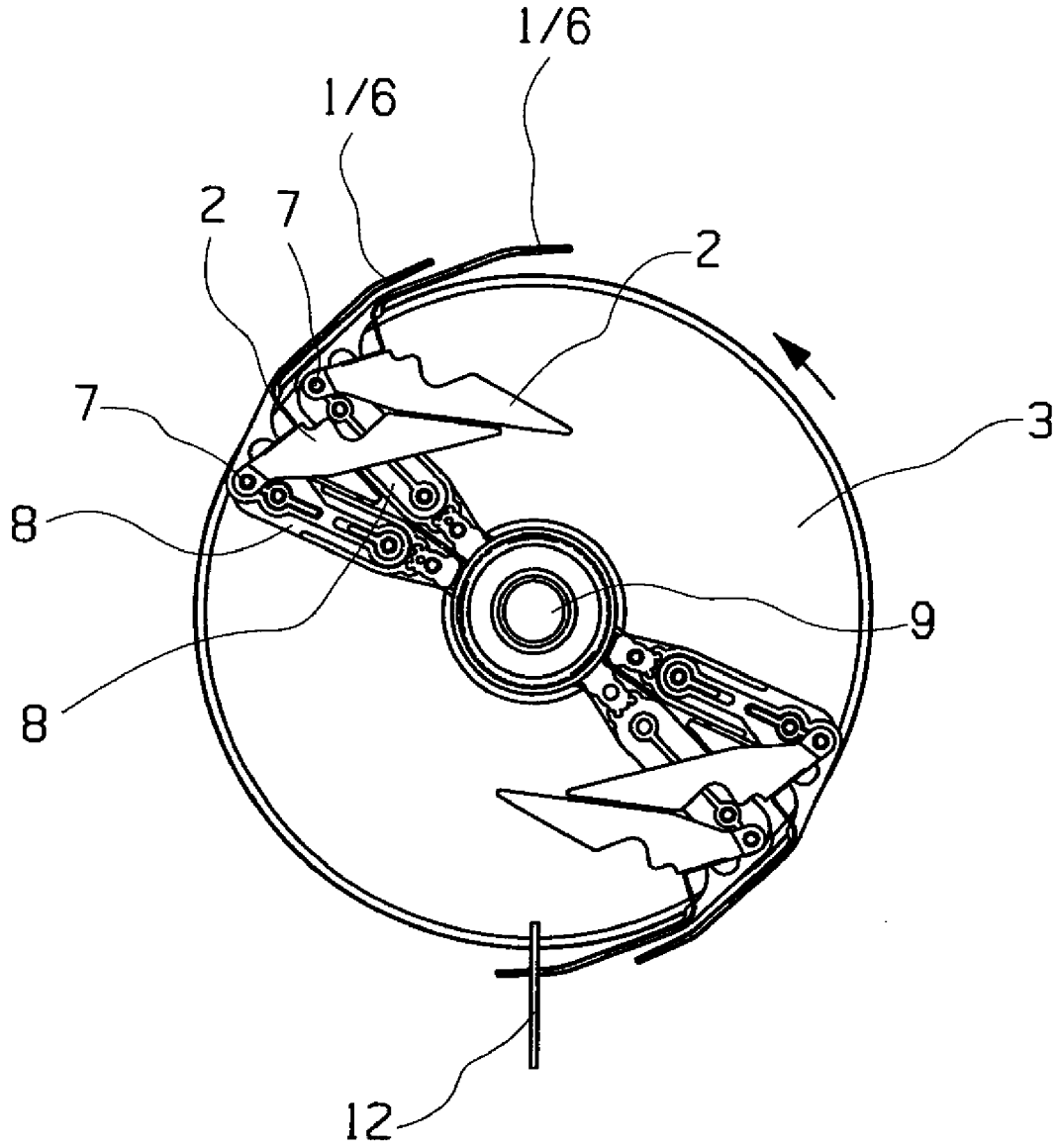
FIG. 1 a cross-section through an inventive device.

The inventive device preferably comprises, for deflecting and transporting the sheets, a total of four first sheet transport elements 3, which are configured substantially as wheels and can be driven so as to rotate. One of these first sheet transport elements 3 is shown in FIG. 1. Coaxially with respect to these first sheet transport elements 3, i.e., between each two first sheet transport elements 3, there are two second sheet transport elements with overlap elements 6, which overlap and grasp the leading edges of the sheets to be transported in that said elements hold the leading edges in cooperation with the peripheral surfaces of the sheet transport elements 3. The second sheet transport elements 8 are substantially configured in the form of an S, in which case said elements can rotate about their center of gravity—configured as a hub—on their joint axis 9 with the first sheet transport elements 3, and in which case each of the end extensions of said elements are configured so as to form overlap elements 6.

The sheets are deposited and stacked against a stop bar 12, through which the sheet transport elements 3, 8 can be rotated by means of cutouts, in which case the respective sheet is retained by this stop bar 12 (indicated by an interrupted line).

Probes (not shown) are used to sense the respectively attained stack height.

Pressure rollers (not shown) press the sheets against the peripheral surfaces of the first sheet transport elements 3, in order to achieve and maintain the radius of curvature, also, specifically, when relatively short, stiff sheets are processed.

Consequently, the drag element, advantageously, does not disrupt the transport and deposition of the sheet because the drag element is mostly in its inoperative position within the circle of rotation of the sheet transport element. The drag element may project from this circle only for its intended function, i.e., as far as is necessary in order to bridge an existing height difference relative to the stack.

To achieve this, the drag element is preferably linked in such a manner that it may be pivoted out.

A particularly reliable automatic actuation of the drag element is achieved in accordance with a development of the invention in that the pivoting element is linked in such a manner that, during its rotation in the region of the stack, it folds out into its dragging position due to its weight and, in the course of the path of rotation, folds back again into its inoperative position. Preferably, this functionality can additionally be supported in that, at the time the drag element's weight is effective, a weight element is connected with the drag element.

To accomplish this, a weight element is preferably provided which substantially is configured to approximate an arm.

In addition, the drag element is preferably arm-shaped and its free end, like a train, points essentially in a direction opposite the rotary motion.

A special embodiment of the invention provides that the arm-shaped weight element and the arm-shaped drag element are connected with each other substantially approximating a V-shape, and that, in their region of connection, a pivoting axis is provided for their joint pivoting motion.

In accordance with a development of the invention, the total sheet transport has been improved in that at least two coaxially rotatable cooperating sheet transport elements are provided, the first sheet transport element featuring a generated surface acting as a support for the sheet, thus essentially predetermining a path of curvature for the sheet to be transported, and the second sheet transport element comprising at least one overlap element to overlap the received leading edge of the sheet in such a manner that the leading edge of the sheet can be grasped between said overlap element and said generated surface.

In so doing, the drag element is preferably coupled with the second sheet transport element, and the drag element, in its inoperative position, is substantially configured and positioned, viewed from the front side of the device, approximately in such a manner that said drag element is congruent with said overlap element.

Preferably, the inventive device is configured in such a manner that the first sheet transport element has substantially the shape of a disk or wheel.

The second sheet transport element may be substantially configured as a two-armed pivotable beam which has, in the region of its two radially outward extending free ends, an overlap element each, in which case a drag element is assigned to each overlap element. To do so, the functions for grasping the sheet and for bending and stopping the sheet during its transport can advantageously be divided over the sheet transport elements in such a manner that said functions can be performed in a specialized and targeted, and still relatively simple and preferably independently actuatable, manner.

The overlap element is preferably configured substantially simply as a tongue or loop, which follows the path of curvature of the first sheet transport element in an approximately parallel manner.

In accordance with a further development of the invention, the sheet transport is achieved across the width of the sheet in a controlled, safe and optimally aligned manner in that, respectively, at least two first and at least two second coaxial sheet transport elements are provided, which are located relative to each other on a joint axis in a mirror-symmetrical manner in that the two second sheet transport elements are arranged between the two first sheet transport elements, so that a leading edge of a sheet can be grasped in its course parallel to the joint axis of the sheet transport elements by a total of at least four sheet transport elements together, and that a drag element is assigned to each of the overlap elements.

In particular at higher transport speeds, the sheet transport is additionally stabilized advantageously, preferably in that the side of the overlap elements of the second sheet transport elements facing the sheet are at a radial distance from the joint axis, said distance being smaller than the overlapped exterior side of the sheet applying its thickness to the radius of the generated surfaces of the first sheet transport elements, so that the leading edge of the sheet is forced in its travel, in a tension-generating manner in the region of the overlap elements, slightly into the direction of the joint axis and is thus bent, and that each drag element can also be pivoted out over the region covered by the first sheet transport element.

In a further development of the inventive device, improved flexibility and efficiency are achieved in that several, although preferably two, of each of the second sheet transport elements are provided in such a manner that these additional second sheet transport elements can be rotated about their joint axis substantially independently of each other, and that thus one of these second sheet transport elements is ready to receive or grasp the next sheet when another of these second sheet transport elements is still occupied with transporting or depositing a previous sheet, and that a drag element is assigned to each of the overlap elements of each of these second sheet transport elements. The two second sheet transport elements can be moved independently of each other, so that, for example, one of these two sheet transport elements deposits a sheet carefully and slowly on the stack, or may even briefly stop in doing so, while the other second sheet transport element already rapidly transports the next sheet in the direction toward the stack. While this other sheet transport element, in turn, is occupied with the slower deposition of the sheet on the stack, one of the second sheet transport elements may already return rapidly to the receiving location for the next sheet and pick up and grasp said sheet.

In order to aid the curving support of, in particular, even a short stiff sheet, at least one guide element that blocks one of the grasped sheets at least in centrifugal direction, can be interposed between a pickup site and a release site of the sheet in order to maintain the radius of curvature of the sheet by force. This may be accomplished by a pressure roller, the position of which can preferably be changed additionally along the sheet's transport path.

In order to create, in particular, partial stacks, which are transversely offset with respect to each other, and which can be removed easier from a sheet delivery means, and which, for example, may be assigned to different print jobs, preferably at least one shifting element coupled with at least one of the sheet transport elements is provided for transversely shifting a sheet to be deposited in a manner substantially parallel to the joint axis of the sheet transport elements. This can be, for example, a temporarily actuated transport roller (friction roller) having an axis that extends horizontally and perpendicularly to the axis of the sheet transport elements. This roller may move, for example on a specifically widened overlap element of a sheet transport element.

Figure 2:
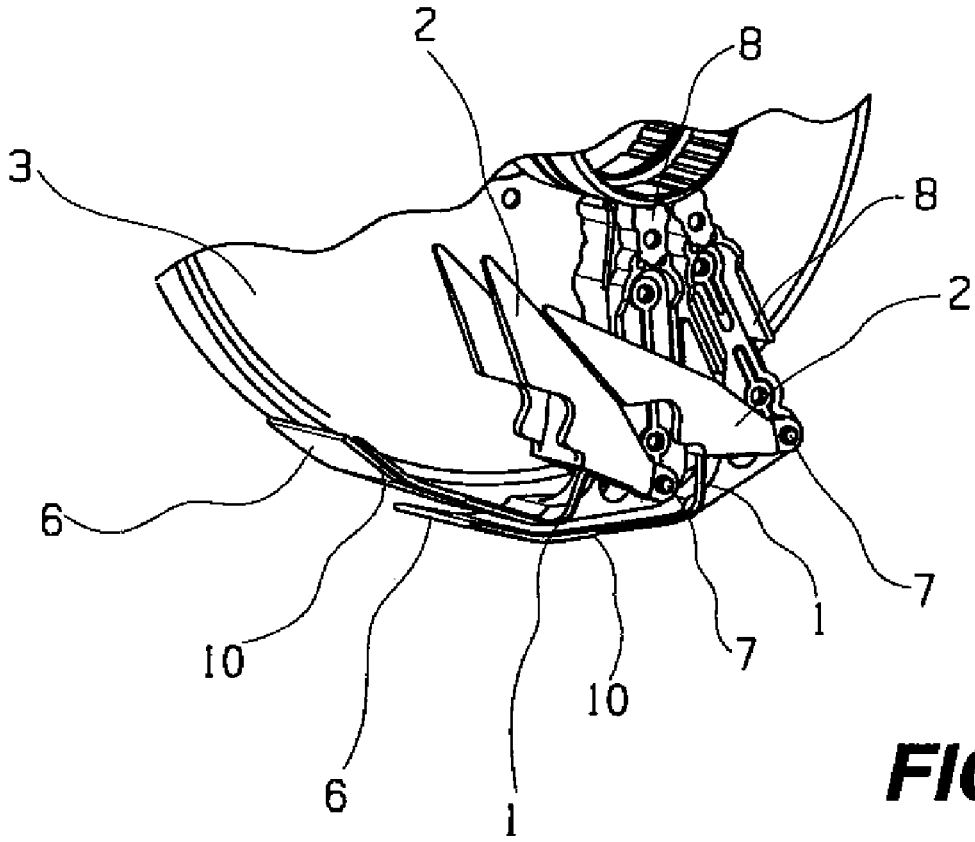
FIG. 2 a perspective elevation of a detail of the region shown in FIG. 1.

In accordance with the invention, the device comprises, in addition, drag elements 1, which, by means of an additional rotation of the system, again neatly pull the deposited sheets toward stop bar 12. These drag elements 1 have a substantially arm-shaped design and are arranged, respectively, so as to be associated with overlap elements 6. In order to achieve a better frictional contact with the sheets, said overlap elements have a friction lining 10 on their underside (FIG. 2). Also, the drag elements are associated with substantially arm-shaped weight elements 2 arranged at an angle, in which case drag element 1 and weight element 2, together, approximate a V-shape, where its free ends point in the direction opposite the direction of rotation of the system (indicated by an arrow). Various examples of friction linings useful with various embodiments are given in U.S. Pat. No. 5,194,558.

FIG. 1 shows a cross-section of an inventive device. Components that are the same have the same reference numbers as in FIG. 1 also in FIGS. 2 and 3.

FIG. 1 shows, in particular, that the V-shape created by drag element 1 and weight element 2, is pivotally connected approximately in the apex region of an axis 7 or can be folded out of the region of rotation of the system. FIG. 1 shows the V-shapes in inoperative position of the total of four shown drag elements 1. In this inoperative position, the drag elements, in this side elevation, are substantially congruent with the respective overlap elements 6, with which said drag elements are associated or to which they are assigned.

Figure 3:
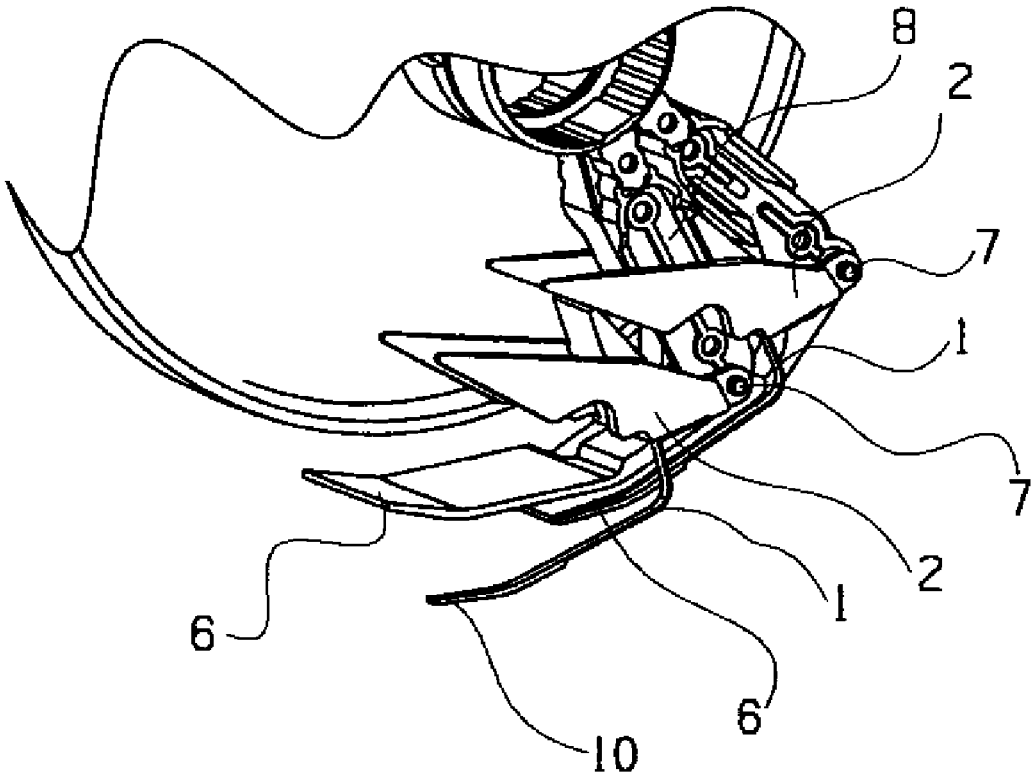
FIG. 3 the detail of FIG. 2 in a slightly different rotary position of the device; and, FIG. 4 a perspective elevation of substantially the entire device, i.e., to offer a better visual impression without reference numbers.

FIGS. 2 and 3 show a detail of a side elevation as in FIG. 1, perspectively, in slightly different rotary positions. In FIG. 2, the lower drag element is still in its inoperative position as in FIG. 1. In FIG. 3, after the associate second sheet transport element 8 has rotated slightly farther, the drag element is suddenly in its folded-out operative position, in which it lies on top of the just deposited sheet. The folding out operation is effected in an automatically timed manner by the gravitational force acting on drag element 1 and on weight element 2.

Figure 4:
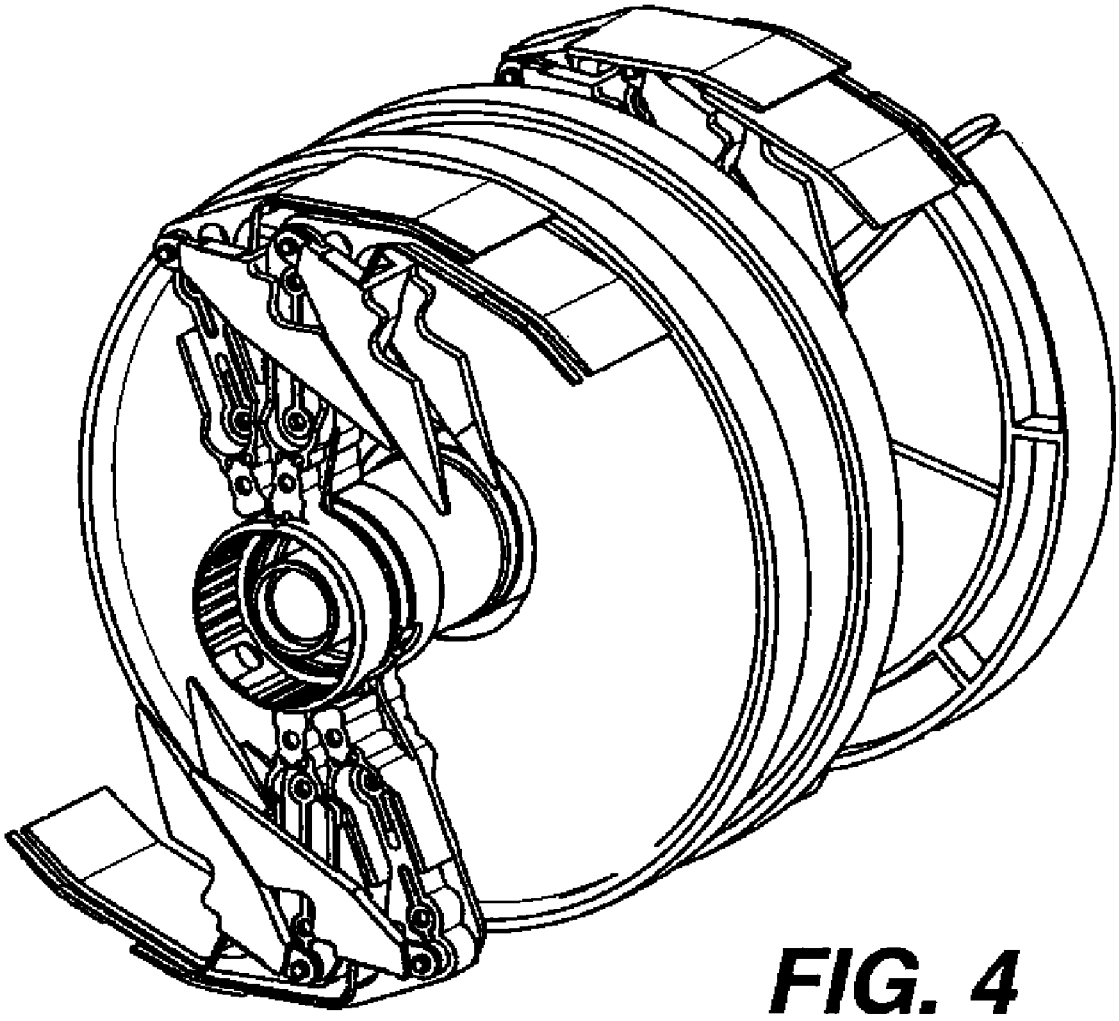

FIG. 4 is a substantially perspective view of the entire device, i.e., for a better visual impression, without reference numbers. In this illustration, the lowest drag elements 1 are in their position as in FIG. 2.

Hereinafter, the overall design and function of the illustrated device will be explained again:

In the illustrated rotating sheet delivery system, a sheet to be deposited is pulled into the rotating system by means of first sheet transport elements 3, which are driven at sheet transport speed. Located on the exterior diameter is a pressure roller pair (not shown), which ensures that the sheet is transferred to the first sheet transport elements 3. In order for the sheet to also follow the driven first sheet transport elements 3 on its circular path, second sheet transport elements 8 are used, which receive the sheets in a nip between the first sheet transport elements 3 and the overlap elements 6 of the second sheet transport elements 8, thus allowing the sheets to follow the contour of the radius. After the sheet has been picked up, the second sheet transport element 8 follows the first sheet transport elements 3 also at sheet transport speed. In this way, the sheet to be deposited is deflected by 180 degrees and guided against a stop bar 12.

Before the trailing edge of the sheet leaves the point of contact between pressure roller pair and the driven first sheet transport elements 3, the leading edge of the sheet reaches stop bar 12, while overlap elements 6 underneath continue to move and release the sheet so that it may drop onto the stack. Precisely at this moment of dropping, the sheet is not held. As a result of this free floating of the sheet, it is possible for the sheet to slip slightly away from stop bar 12. In order to prevent excessive floating, the height difference between the overlap elements 6 and the stack surface must be minimized. Experience has shown values that range from 2 to 3 mm. However, these values apply only to an optimally flat stack. Leaving this optimal zero position of the stack, as already described, the wedge-shaped formation of a stack could result in greater differences. These differences must be evened out.

This is the reason for the use of drag elements 1, which, upon the impingement of the sheet on the stack, again carry out another alignment at stop bar 12.

In so doing, it should preferably be possible to bridge a potential stack irregularity of a minimum of 15 mm. For example, the described solution can also be used to compensate for a stack irregularity of up to 30 mm. Advantageously, the active drag elements 1 do not need to be driven, but they automatically perform the right actions at the right time.

The appropriately configured drag elements 1 are arranged in a parallel manner next to overlap elements 6 and, in side view, have the same cross-section as overlap elements 6. Drag elements 1 are rotatably mounted at the end of overlap elements 6, on said latter elements' mounts. In the direction of the center points (axis 9) of the second sheet transport elements 8, i.e., the central point of rotation of the rotating sheet delivery system, extending from the drag elements, weight elements 2 representing weights for use in the actuation process of drag elements 1 are provided. The underside of drag elements 1 is provided with a friction lining 10, which ensures that, when drag elements 1 impinge on the sheet, a high coefficient of friction is achieved to ensure the secure transport of the sheet against stop bar 12. In addition to the friction lining 10 on the underside, there are additional weight elements 2 acting as weights providing the required degree of pressure on the sheet that is to be moved.

In so doing, an optimal combination of the grip of the frictional lining and the pressure exerted by the weights must be achieved, so that any sheet format with any possible sheet weight can be pulled properly against stop bar 12. Extremes are represented by the largest sheet format having the maximum sheet weight compared with the smallest sheet format having the minimum sheet weight. In so doing, it is necessary that the largest and heaviest sheet format can be pulled against stop bar 12 and, at the same time, with the same performance, even the smallest and lightest weight format can be pulled against stop bar 12, with the same effectiveness and specifically without being damaged. The frictional lining 10, and the weight required therefor, are to be defined in view of these two extremes.

The correct time for the required folding out of drag elements 1 can be achieved by the skillful selection of the position of the center of rotation (axis 7).

The sequence of motions carried out by drag elements 1 is as follows:

Starting with the sheet picker located 180 degrees above stop bar 12, drag elements 1 are folded in at the height of overlap elements 6. In side view, both systems are in alignment. In the end, the weight-providing weight element 2 ensures this alignment. Thus, a sheet coming out of the paper path can move unobstructed into the nip between overlap elements 6 and the peripheral surfaces of the first sheet transport elements 3.

As rotation starts and the sheet to be deposited at stop bar 12 is approaching, the positions of the center of rotation (axis 7) and the center of gravity for engagement of the weight at the V-shape consisting of a drag element 1 and a weight element 2 change, so that drag elements 1 gradually fold out of their folded-in inoperative position. Finally, after a 90-degree rotation, drag elements 1 completely move out, so that their leading edge is pivoted outward, for example, approximately 30 mm outside the region of rotation of overlap elements 6.

During the continued rotation of the system, drag elements 1 impinge on the previously deposited sheet which, as already described above, may lie unaligned on the stack.

In the course of the described sequence, the sheet which has been overlapped by overlap elements 6 and which is to be deposited remains totally unaffected.

During another rotation, drag elements 1, which have dropped on the sheet to be aligned, now pull the sheet against stop bar 12.

Drag elements 1, which are pivoted out initially approximately 30 mm during the fold-out operation, now align themselves in accordance with the stack surface or stack irregularity relative to their center of rotation (axis 7).

Inasmuch as drag elements 1 function independently of each other, the most varied inclined positions of the stack (for example, up to a maximum of 30 mm) can be detected. Consequently, the achieved contact with the stack surface is always optimal, without having different forces acting on the two engaged drag elements 1.

After the sheet to be deposited has arrived at stop bar 12, overlap elements 6, as well as drag elements 1, move out of the stack's engagement region. In so doing, these elements move through cutouts in stop bar 12 and out of the engagement region.

At the very moment when drag elements 1 leave the stack, they again drop back into their maximum folded-out position. The gap in stop bar 12 and the subsequent features have been configured accordingly.

During continued rotation, ultimately back in sheet-picking position, drag elements 1 again move back into their folded-in inoperative position. Thus, a continuous operation of drag elements 1 is achieved, in which case, again, the already existing rotary motion and gravitational force are utilized.

Special attention must now also be paid to the time of impingement of the two drag elements 1 on the stack or on the sheet that is to be aligned.

Inasmuch as drag elements 1 are rotatably mounted to overlap elements 6, said drag elements are also subject to the high sheet transport speed. As a result, it is noticeable that the already resting sheet is again subjected to an impelling force, with the effect that the sheet is again moved at high speed against stop bar 12. In so doing, the energy applied to the sheet is great enough, so that drag elements 1 can no longer hold the sheet against the stop bar. The sheet moves underneath drag elements 1 and, despite the high coefficient of friction and weight elements 2, away from stop bar 12. This is in agreement with the law of conservation of momentum, because stop bar 12 is a stationary element.

In order to avoid having to increase the coefficient of friction and the intrinsic weight of drag elements 1, either a distinct reduction of velocity of the entire system before impingement of the sheet to be aligned on stop bar 12, or a small intermediate stop, are recommended. This may be accomplished in two ways:

Variant A:

If the sheet, which is being rotated and to be deposited, strikes stop bar 12, the rotary motion is interrupted by a small stop. In this instance, the sheet beneath overlap elements 6 has already been contacted by drag elements 1, and this sheet may already have bounced off on the stack; however, drag elements 1 are configured long enough so as to still have sufficient length after this stop in order to be able to again align the sheet on stop bar 12.

Variant B:

The sheet, which is being rotated and to be deposited, does not, as is otherwise preferred, enter as low as possible beneath overlap elements 6. Instead, a sufficiently large free space is provided, which allows an intermediate stop or a reduction of velocity to be initiated prior to the impingement of the sheet to be deposited at stop bar 12. During this brief braking or stopping action, the sheet being deflected enters deeper into the nip between the peripheral surfaces of the first sheet transport elements 3 and overlap elements 6. As a result of this, however, a braking or stopping action initiated prior to the impingement of drag elements 1 on the previously deposited sheet can be carried out, without thus obstructing with the sheet to be deposited.

Both variants are conceivable; however, Variant B is more elegant because it does not require the use of unnecessary energy on an already resting sheet. In general, the stack is held more motionless.

Finally, it should be noted that the illustrated embodiment of the rotating picker system comprises two independently operating second sheet transport element twin systems 8, in which case their overlap elements 6 may move closely inside of each other. This so-called immersion into each other (recognizable in the side elevation of FIG. 1) results whenever a sheet to be deposited is moved toward stop bar 12 and the pair of overlap elements 6 underneath has been pulled out through stop bar 12 and, parallel thereto, the subsequent pair of overlap elements 6 is in sheet-receiving position. In so doing, two overlap element pair systems 6 immerse into each other.

In order to prevent drag elements 1 from interfering with each other's functions during this mutual immersion, this solution requires that consecutive drag elements 1 be offset as regards their depth (considering the side elevation of FIG. 1).

Otherwise, drag element 1 located on the deposited sheet would be lifted again by the subsequent drag element 1 and, thus, would no longer be able to align the sheet.

In general, this embodiment represents a highly flexible system, which is capable of following even extreme stack irregularities.

A relatively cost-effective embodiment has been created, because the functional elements are activated automatically.

What is claimed is:

1. A device for depositing sheets for a printing machine, comprising:

a support for a sheet to define a path of rotation of the sheet;

first and second coaxial, drivable sheet transport elements that can be rotated about their joint axis independently of each other, each for grasping a leading edge of a sheet and depositing the sheet on a stack after the sheet has traveled through the path of rotation, so that one of the transport elements is ready to receive or grasp the next sheet when another of the transport elements is still occupied with transporting or depositing a previous sheet;

each transport element including:

at least one radially outward extending free end;

at least one overlap element to overlap the received leading edge of the sheet in such manner that the leading edge of the sheet can be grasped between said overlap element and said support, wherein the rotation of the transport element causes a region of rotation of the corresponding overlap element to be defined; and a pivotable drag element attached to the free end of the corresponding transport element for pulling a sheet that has been deposited on the stack toward a mechanical stop after the sheet is released by the overlap element, each drag element pivoting between an inoperative position within the region of rotation of the corresponding overlap element and an operative position in which it is pivoted at least partially out of the region of rotation of the corresponding overlap element in order to perform its dragging function.

2. The device as in claim 1, wherein each pivoting drag element is linked in such a manner that, during its rotation in the region of the stack, it folds out into its dragging position due to its weight and, in the course of the path of rotation, folds in again into its inoperative position.

3. The device as in claim 2, further including a respective weight element connected to each drag element.

4. The device as in claim 3, wherein each weight element substantially has the configuration of an arm.

5. The device as in claim 4, wherein each drag element is substantially arm-shaped and its free end points essentially in a direction opposite the rotary motion of the corresponding transport element.

6. The device as in claim 5, wherein the arm-shaped weight element and the arm-shaped drag element are connected with each other to substantially approximate a V-shape, and a pivoting axis for their joint pivoting motion is provided around their region of connection.

7. The device as in claim 1, wherein each sheet transport element is substantially configured as a two-armed pivotable beam which has, at the respective radially outward extending free ends of the two arms, a corresponding overlap element and a corresponding drag element.

8. The device as in claim 7, wherein each overlap element is configured substantially as a tongue or loop, which follows the path of rotation of the sheet in an approximately parallel manner.

9. The device as in claim 1, including at least one guide element that blocks one of the grasped sheets at least in a centrifugal direction and is interposed between a pickup site and a release site of the sheet, in order to maintain the radius of curvature of the sheet by force.

10. The device as in claim 9, including at least one shifting element coupled with at least one of the sheet transport elements for transversely shifting a sheet to be deposited in a manner substantially parallel to the joint axis of the sheet transport elements.

* * * * *